United States Patent [19]

Taguchi

[11] Patent Number: 5,027,404

[45] Date of Patent: Jun. 25, 1991

[54] PATTERN MATCHING VOCODER

[75] Inventor: Tetsu Taguchi, Tokyo, Japan

[73] Assignee: NEC Corporation, Tokyo, Japan

[21] Appl. No.: 522,411

[22] Filed: May 11, 1990

Related U.S. Application Data

[63] Continuation of Ser. No. 841,961, Mar. 20, 1986, abandoned.

[30] Foreign Application Priority Data

| | | | |
|---|---|---|---|
| Mar. 20, 1985 | [JP] | Japan | 60-57327 |
| Apr. 12, 1985 | [JP] | Japan | 60-77827 |
| May 7, 1985 | [JP] | Japan | 60-96222 |
| Jun. 13, 1985 | [JP] | Japan | 60-128587 |

[51] Int. Cl.[5] ..... G10L 9/18

[52] U.S. Cl. ..... 381/37; 381/36

[58] Field of Search ..... 364/513.5; 381/29–43, 381/51, 53

[56] References Cited

U.S. PATENT DOCUMENTS

| | | | |
|---|---|---|---|
| 4,301,329 | 11/1981 | Taguchi | 381/37 |
| 4,393,272 | 7/1983 | Itakura et al. | 381/39 |
| 4,486,899 | 12/1984 | Fushikida | 381/36 |
| 4,541,111 | 9/1985 | Takashima et al. | 381/51 |
| 4,590,605 | 5/1986 | Hataoka et al. | 381/43 |
| 4,661,915 | 4/1987 | Ott | 381/41 |
| 4,701,955 | 10/1987 | Taguchi | 381/51 |
| 4,712,243 | 12/1987 | Ninomiya et al. | 381/43 |
| 4,715,004 | 12/1987 | Kabasawa et al. | 364/513.5 |
| 4,741,037 | 4/1988 | Goldstein | 381/31 |

OTHER PUBLICATIONS

Chandra et al., "Linear Prediction with a Variable Analysis Frame Size", IEEE Trans. on ASSP, vol. ASSP-25, No. 4, Aug., 1977, pp. 322–330.

Rabiner et al., "Speaker-Independent Recognition of Isolated Words Using Clustering Techniques", IEEE Transactions on ASSP, vol. ASSP-27, No. 4, Aug., 1979, pp. 336–349.

"A Variable Frame Length Linear Predictive Coder", ICASSP 1978, Turner et al., pp. 454–457.

*Primary Examiner*—Dale M. Shaw
*Assistant Examiner*—David D. Knepper
*Attorney, Agent, or Firm*—Sughrue, Mion, Zinn, Macpeak & Seas

[57] ABSTRACT

A pattern matching vocoder includes first and second reference pattern memories, a pattern matching processor, and a frame selector. The first pattern memory stores reference vector patterns clustered by a distribution of the number of times of occurrence for spectral envelope vectors of an input speech signal. The second reference pattern memory stores reference vector patterns clustered by pole frequencies, pole bandwidths and a bandwidth of the input speech signal. The pattern matching processor divides the bandwidth of the speech signal into frequency regions and performs pattern matching using, as spectral envelope vectors, power ratios between the frequency regions. The frame selector performs frame selection using, as an evaluation value, a total distortion consisting of a vector distortion caused by pattern matching and a time distortion caused by frame selection with a DP (Dynamic Programming) scheme.

8 Claims, 5 Drawing Sheets

PATTERN MATCHING VOCODER

This is a continuation of U.S. application Ser. No. 06,841,961 filed Mar. 20, 1986, now abandoned.

BACKGROUND OF THE INVENTION

The present invention relates to a pattern matching vocoder and, more particularly, to an LSP pattern matching vocoder.

An LSP (Line Spectrum Pairs) pattern matching vocoder is a typical example of a pattern matching vocoder for comparing a reference voice pattern with a distribution pattern of spectral envelopes of input speech, causing an analyzer unit to send to a synthesizer unit a best matching reference pattern (i.e., label data of a reference pattern with a minimum spectral distortion) as spectral envelope data together with exciting source data, and for causing the synthesizer unit to synthesize speech by detecting the spectral envelope data as speed synthesis filter coefficients according to the label of the reference pattern.

In a conventional pattern matching vocoder, a label of the best matching reference pattern is sent in place of the spectral envelope data to greatly decrease the transmission data. In order to minimize the spectral distortion generated as a matching error, a weighting coefficient is added to each vector element for matching a reference pattern and input speech.

In a conventional basic LSP pattern matching vocoder, matching between the input speech and a reference pattern is performed for each analysis frame using as a matching measure a spectral distance $D_{ij}$ given in equation (1) below:

$$D_{ij} = 1/\pi \int_0^{\pi} (S_i(\omega) - S_j(\omega))^2 d\omega \approx \sum_{k=1}^{M} W_k(P_k^{(i)} - P_k^{(j)})^2 \quad (1)$$

where $S_i(\omega)$ and $S_j(\omega)$ are logarithmic spectra of frames i and j, $P_k^{(i)}$ and $P_k^{(j)}$ are LSP coefficients of Mth order, and $W_k$ is a weighting coefficient added to each of the first-to Mth-order LSP coefficients and is generally represented by spectrum sensitivity.

The approximation in equation (1) is normally used which requires a smaller number of calculations. In this case, the number of vector elements is M.

Pattern matching is normally performed to select a minimum $D_{ij}$, i.e., a spectral distortion obtained by calculating a difference between two vector elements of input speech and a reference pattern, squaring each difference, multiplying by weight coefficient, and adding the weighted squared differences. Different weight coefficients are multiplied to the different vector elements to minimize the spectral distortion.

The conventional LSP pattern matching vocoder has the following drawbacks.

(1) The reference vector patterns in the analyzer unit and the synthesizer unit in the LSP pattern matching vocoder are patterns clustered by a spectral equidistance. The input speech signal is synthesized by matching these reference vector patterns with LSP coefficient vector patterns extracted from the input speech.

However, the frequency of occurrence of the conventional reference vector pattern does not linearly correspond to that of the LSP coefficient vectors in a vector space. When the clustered reference vector pattern groups are matched with the LSP patterns at the spectral equidistance by neglecting the above condition, magnitudes of differences therebetween cannot be greatly minimized. In other words, quantization distortions in pattern matching have lower limits.

(2) In a conventional pattern matching vocoder, a sum of the squares of the differences between vector elements of the reference pattern and the input speech is used as a matching measure. The spectral sensitivity corresponding to this weighting coefficient represents a spectral change corresponding to a small change in spectral envelope and is preset on the basis of speech information in advance.

Weighting utilizing such spectral sensitivity is defined as a scheme for providing the spectral envelope with a uniform change corresponding to weighting. Therefore, pole conditions (i.e., center frequency and bandwidth) largely associated with hearing are not separated from the speech and are processed together. The "pole" is a solution for setting zero $A_p(Z^{-1})$ in transfer function (2) of a tracheal filter realized by an all-pole digital filter:

$$H(Z)^{-1} = 1/A_p(Z^{-1}) \quad (2)$$

$$\text{for } A_p(Z^{-1} = 1 + \alpha_1 Z^{-1} + \alpha_2 Z^{-2} \ldots + \alpha_p Z^{-p}$$

where $Z = \exp(j\lambda)$, $\lambda = 2\pi\Delta Tf$, $\Delta T$ is a sampling cycle, f is a frequency, p is the order of the digital filters, and $\alpha_1$ to $\alpha_p$ are pth-order LPC coefficients as control parameters of the all-pole digital filter.

However, hearing sensitivity is more susceptive to a change in center frequency than to a change in pole bandwidth. Therefore, a scheme for uniformly evaluating and weighting spectral distortion using the spectral sensitivity is not plausible in principle.

(3) A bandsplitting vocoder is known which performs LPC (Linear Prediction Coefficient) analysis for each of a plurality of ranges obtained by dividing a frequency band of an input speech signal. The vocoder of this type eliminates two drawbacks inherent to LSP analysis. First, the formant range is underestimated. Second, a higher-order formant with small energy, e.g., a formant of third order, has poor approximate characteristics as compared with the formant of first order. These two drawbacks are estimated to be caused by excessive concentration of poles in a frequency region concentrated with energy from the formant of first order. In order to prevent the poles from being concentrated in a specific frequency region, the bandsplitting vocoder divides the frequency band into a plurality of frequency regions each of which is subjected to LPC analysis, thereby eliminating the above two drawbacks. In this case, when the frequency band is divided into a large number of frequency regions, the respective frequency regions tend to have uniform energy profiles, and band compression of the input speech signal is not effected at all. In general, the frequency band is divided into two to four frequency regions. The split frequency regions need not be at equal intervals, but are determined at a logarithmic ratio such that formants as poles of spectral envelopes are respectively included in the frequency regions. However, in the bandsplitting vocoder of this type, discontinuity occurs in the interband spectrum of the synthesizer unit in the vocoder, thus degrading the quality of synthesized sounds.

(4) Instead of matching reference patterns with the input speech vectors and sending each selected reference pattern for each corresponding analysis frame, L reference patterns corresponding to L representative analysis frames extracted for each section consisting of continuous K analysis frames are selected, and, together with the L reference patterns, are sent with a reference pattern number, i.e., a repeat bit from the analyzer unit, to the synthesizer unit in the vocoder. Thus, the reference patterns selected for each section are sent together with an optimal reference pattern label of the representative analysis frames for each section. In other words, the designation code is sent together with the repeat bit to the synthesizer unit in the vocoder. The representative analysis frames for each section are obtained by approximating the spectral envelope parameter profile of all analysis frames with an optimal approximation function. The optimal approximation function can be a rectangular, trapezoidal or linear approximation function in accordance with a given application of the vocoder. In normal operation, the proper function is selected by DP method.

When an optimal approximation is performed using a rectangular approximation function, the contents of the K analysis frames for each section are expressed by the contents of the L analysis frames constituting the rectangular function and the analysis frame numbers respectively represented thereby.

In a conventional variable frame length pattern matching vocoder of this type, selection of representative frames for constituting a variable length frame and selection of reference patterns by pattern matching are independently performed. The spectral distortion generated during pattern matching, i.e., quantization distortion and so-called time distortion on the basis of a difference between spectral distances upon substituting the frames with the representative frames, are therefore independently included. In this state, speech analysis and synthesis are performed, thus inevitably degrading the quality of synthesized sounds.

SUMMARY OF THE INVENTION

It is, therefore, a principal object of the present invention to provide a pattern matching vocoder wherein the quality of synthesized sounds can be improved.

It is another object of the present invention to provide an LSP pattern matching vocoder comprising a memory for storing reference vector patterns divided by clustering corresponding to a distribution of occurrence of spectral envelope vectors.

It is still another object of the present invention to provide an LSP pattern matching vocoder wherein spectral distortion generated upon matching between reference pattern vectors and analysis parameter vectors can be optimally evaluated since the spectral envelopes of input speech are expressed as a set of center frequencies of a plurality of poles and their bandwidths.

It is still another object of the present invention to provide a bandsplitting pattern matching vocoder wherein discontinuity of the interband spectrum at the synthesizer unit in the vocoder can be greatly eliminated.

It is still another object of the present invention to provide a pattern matching vocoder for systematically processing spectral and time distortions.

DETAILED DESCRIPTION OF THE PREFERRED EMBODIMENTS

Figure 1:
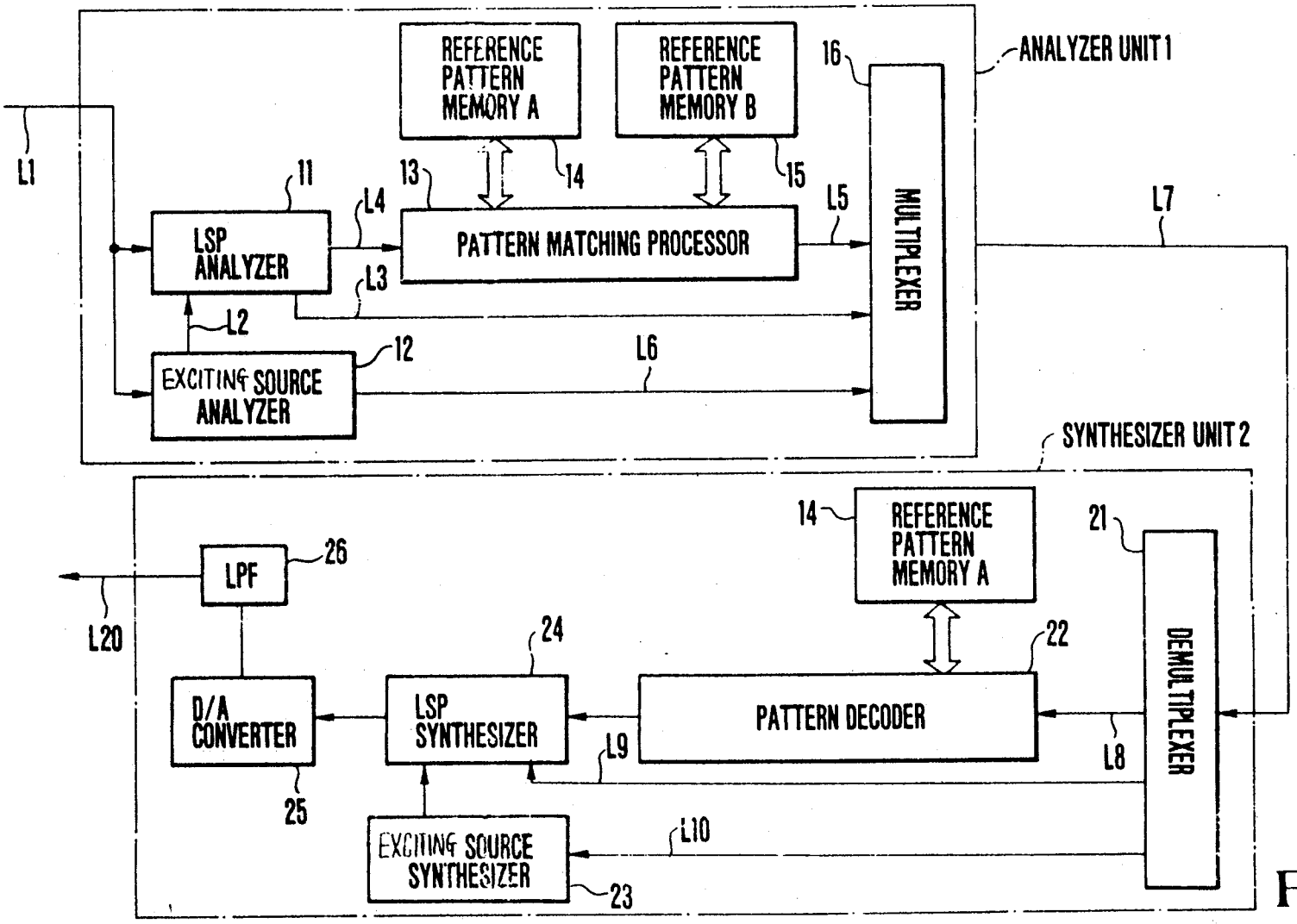
FIG. 1 is a block diagram of a pattern matching vocoder according to an embodiment of the present invention.

The present invention will be described in detail with reference to the accompanying drawings. FIG. 1 is a block diagram showing an LSP pattern matching vocoder according to an embodiment of the present invention. The LSP pattern matching vocoder in FIG. 1 comprises an analyzer unit 1 and a synthesizer unit 2. The analyzer unit 1 consists of an LSP analyzer 11, an exciting source analyzer 12, a pattern matching processor 13, a reference pattern memory A 14, a reference pattern memory B 15, and a multiplexer 16. The synthesizer unit 2 includes a demultiplexer 21, a pattern decoder 22, an exciting source synthesizer 23, an LSP synthesizer 24, a D/A converter 25, and an LPF (Low-Pass Filter) 26. The synthesizer unit 2 also includes a memory of the same type as the reference pattern memory A 14.

In the analyzer unit 1, an input speech signal is supplied to the LSP analyzer 11 and the exciting source analyzer 12 through an input line L1.

In the LSP analyzer 11, an unnecessary high-frequency component in the input speech signal is eliminated by an LPF (not shown), and a resultant signal is quantized by an A/D converter to a digital speech signal of a predetermined number of bits. The digital speech signal is multiplied with a window function at predetermined intervals. The extracted digital speech signals for every predetermined interval serve as analysis frames. LPC analysis is then performed for the digital data of each frame. An LPC of a predetermined order, 10th order in this embodiment, is extracted by a known means. An LSP coefficient is then derived from the LPC Of 10th order.

A known means for deriving the LSP coefficient from the LPC is exemplified by a scheme for solving an equation of higher order utilizing a Newtonian repetition or a zero point search scheme. The former scheme is employed in this embodiment.

An LSP coefficient sequence for each basic frame is converted to a variable length frame data. The variable length frame data is supplied to the pattern matching processor 13. The variable frame length conversion is performed in the following manner.

The LSP analyzer 11 receives voiced/unvoiced/silent data concerning the input speech signal from the exciting source analyzer 12 through a line L2 and performs approximation processing for each section consisting of a predetermined number of analysis frames. The LSP analyzer 11 then selects representative frames smaller than different maximum numbers of voiced and unvoiced intervals, respectively consisting of voiced and unvoiced sounds. Instead of sending all frame data, the representative frame and data (i.e., repeat bit data) represents the number of frames designated by the representative frame. The repeat bit data is supplied to the multiplexer 16 through a line L3, and the representative frame data is supplied to the pattern matching processor 13 through a line L4.

The pattern matching processor 13 performs matching between the input data and reference pattern vectors stored in the reference pattern memories A 14 and B 15 by measuring spectral distances given by equation (1). An inner product of the Nth-order LSP coefficient $P_k^{(i)}$ as the space vector of the input speech signal and the space vector $P_k^{(j)}$ registered in a reference vector pattern is calculated for the LSP coefficient of each order. $W_k$ as a predetermined weighting coefficient is multiplied with the inner product for every LSP frequency corresponding to the order of the LSP coefficient. This product is calculated for each variable length frame.

The reference vector patterns stored in the reference pattern memories A 14 and B 15 are simulated with another computer or prepared using the vocoder of this embodiment.

The preparation of a reference vector pattern clustered at a spectral equidistance and stored in the reference pattern memory B 15 will be described below.

This reference vector pattern is basically determined in the following manner.

Using speech information prepared in advance, preprocessing, such as elimination of voiced intervals, removal of unnecessary adjacent frames, and classification based on the voiced/unvoiced/silent pattern, is performed using the LPC analysis. The reference pattern is determined and registered according to clustering procedures (1) to (5) below.

(1) N vector patterns are generally included in an LSP coefficient vector space U of 10th (in general, Mth) order.

(2) The spectral distance $D_{ij}$ represented by equation (1) is calculated for each of the N vector patterns. The number of vector patterns having vector distances $D_{ij}$ with values lower than a discrimination value $\theta dB^2$ is calculated and defined as $M_i$ ($i=1,2, \ldots M$).

(3) A vector pattern PL with $\max\{M_i\}$ is found.

(4) All vector patterns including PL and included within the range of $\theta dB^2$ are eliminated from the vector space U, and PL is registered as a reference vector pattern. PL + $\max\{M_i\}$ is also registered.

(5) Clustering procedures (1) to (4) are repeated for the remaining vector patterns until the number of vector patterns included in the vector space U reaches zero.

The reference vector patterns are thus sequentially determined by clustering procedures (1) to (5). Respective reference vector patterns are registered as representative vector patterns of respective vector space regions obtained by dividing the vector space of 10th order. Such clustering procedures are prior art procedures. The different densities of occurrence in vector patterns are not considered.

According to this embodiment, the value $\theta dB^2$ of the spectral distance $D_{ij}$ in clustering procedure (2) is larger than the conventional spectral equidistance clustering by a value corresponding to a preset level. Therefore, the N vector patterns are assigned to a larger spectral space than that in the conventional clustering. The values $\theta dB^2$ in the larger vector regions can therefore be optimized on the basis of a large number of fragments of empirical speech information. Such optimization can be performed in the same manner as in clustering procedures (1) to (5).

Reference vector patterns representing large vector regions with a larger number of vector patterns than that obtained by the conventional spectral equidistance clustering are stored in the reference pattern memory B 15. In this case, the number of vector regions constituting the vector space is smaller than in the prior art.

The LSP coefficient vector pattern for every variable length frame of the input speech signal supplied to the pattern matching processor 13 determines the reference vector pattern stored in the reference pattern memory B 15 and the data representing a minimum spectral distance obtained by measuring spectral distances by equation (1). This determination is a preliminary selection. The LSP coefficient vector pattern finally selects the pattern from the reference pattern memory A 14.

The reference pattern memory A 14 stores reference vector patterns clustered in association with the distribution density of spectral envelope vectors in the vector space of 10th order in this embodiment. According to clustering corresponding to the frequency of occurrence, a vector space given such that the spectral envelope vector patterns are included in reference patterns PL as NPL within $\theta dB^2$ is redivided in accordance with procedures (1) to (5) for dividing the vector space previously divided at the spectral equidistance. In this case, $\theta dB^2$ can be set to be proportional to, e.g., NPL in accordance with the number of vector regions obtained by redivision. In this manner, parameters corresponding to different frequencies of occurrence are used. By preparing the reference vector patterns obtained by redivision, matching between frequently appearing LSP coefficient vector patterns and the reference vector patterns can be performed with high precision. Therefore, the quantization distortion in pattern matching can be effectively decreased.

In the analyzer unit 1 having the reference pattern memory B 15 for storing the reference vector patterns clustered at the spectral equidistance and the reference pattern memory A 14 for storing the reference vector patterns clustered corresponding to the frequencies of occurrence of the spectral envelope vectors, the pattern matching processor 13 performs matching between the LSP coefficient vector patterns from the LSP analyzer 11 with the reference vector pattern groups stored in the reference pattern memory B 15, thereby completing preliminary selection of the reference vector patterns to be finally determined. Subsequently, the LSP coefficient vector patterns are matched with the reference vector pattern groups stored in the reference pattern memory A 14. The pattern matching processor 13 finally selects the reference vector patterns with a minimum spectral distance. The designation number data of these reference vector patterns is supplied to the multiplexer 16 through a line L5. By utilizing preliminary selection, selection processing can be greatly improved.

The exciting source analyzer 12 extracts pitch period data, voiced/unvoiced/silent discrimination data and exciting source intensity data, and supplies them to the multiplexer 16 through a line L6. At the same time, the voiced/unvoiced/silent discrimination data is also supplied to the LSP analyzer 11.

The multiplexer 16 quantizes the reference vector pattern number designation data, the repeat bit data, and the exciting source data described above, and multiplexes them in a predetermined format. Multiplexed data is supplied to the synthesizer unit 2 through a transmission line L7.

In the synthesizer unit 2, the demultiplexer 21 demultiplexes and decodes the multiplexed signal. The reference vector pattern number designation data is supplied to the decoder 22 through a line L8. The repeat bit data is supplied to the LSP synthesizer 24 through a line L9. The exciting source data is supplied to the exciting source synthesizer 23 through a line L10. The pattern decoder 22 reads out the contents of the reference vector pattern designated by an input reference vector pattern number designation code from the memory A 14. The reference pattern memory A 14 in the synthesizer unit 2 is the same as that in the memory A 14. The LSP coefficient sequence for each variable length frame is read out from the reference pattern memory A 14 and is supplied to the LSP synthesizer 24. The LSP synthesizer uses the repeat bit data and the LSP coefficient sequence t reproduce the LSP coefficient of each analysis frame. The reproduced coefficient can be used as a coefficient of a speech synthesis filter constituting an all-pole digital filter of 10th order.

The exciting source synthesizer 23 uses the exciting source data and synthesizes an exciting source for each analysis frame according to a known technique. The exciting source power is supplied to the LSP synthesizer 24 to drive the speech synthesizing filter incorporated in the LSP synthesizer 24. The digital input speech signal is synthesized and output to the D/A converter 25, where it is converted to an analog signal. An unnecessary high-frequency component of the analog signal is eliminated by the LPF 26, and the resultant signal is output via an output line L20.

As a modification of the above embodiment, preliminary selection is not performed by the reference pattern memory B 15.

Figure 2:
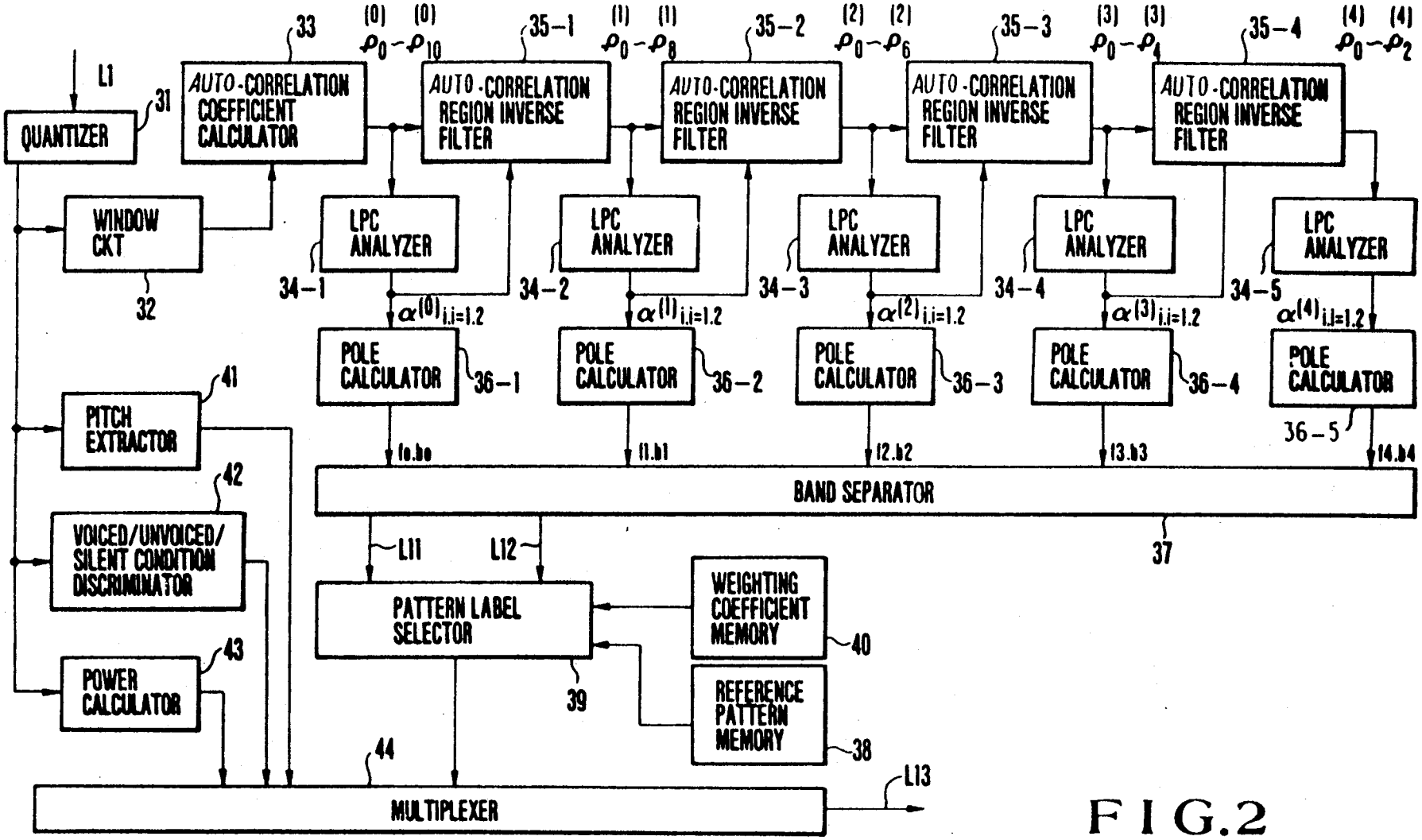
FIG. 2 is a block diagram of an analyzer unit in a pattern matching vocoder according to another embodiment of the present invention.

FIG. 2 is a block diagram of an analyzer unit according to another embodiment of the present invention. Referring to FIG. 2, input speech through an input line L1 is supplied to a quantizer 31.

In the quantizer 31, an unnecessary high-frequency component of input speech is eliminated by an LPF, and the resultant signal is converted by an A/D converter at a predetermined sampling frequency, thereby obtaining a digital signal of a predetermined number of bits. The digital signal is then supplied as a digital speech signal to a window circuit 32, a pitch extractor 41, a voiced/unvoiced/silent discriminator 42 and a power calculator 43. The pitch extractor 41, the voiced/unvoiced/silent discriminator 42, and the power calculator 43 constitute the exciting source analyzer of FIG. 1.

The digital speech signal input to the window circuit 32 is multiplied with a predetermined window function at predetermined time intervals, thereby sequentially extracting the digital signals. These signals are temporarily stored in a buffer memory. The signals are sequentially read out from the buffer memory at a basic analysis length. The readout signals are supplied to an autocorrelation coefficient calculator 33. The basic analysis length constitutes a basic analysis frame in which speech is regarded as a steady speech signal. The autocorrelation coefficient calculator 33 calculates up to a predetermined order, i.e., the 10th order in this embodiment, of the autocorrelation coefficients of the digital speech signal input in units of basic analysis frames. These autocorrelation coefficients $\rho_0^{(0)}$ to $\rho_{10}^{(0)}$ are supplied to an LPC analyzer 34-1 and an autocorrelation region inverse filter 35-1. The orders of the autocorrelation coefficients calculated by the autocorrelation calculator 33 correspond to a multiple of the number of pole frequencies to be extracted in the analyzer unit. In this embodiment, LPC coefficients of 2nd order are utilized (to be described later), and five poles are extracted by pole calculators 36-1 to 36-5, thereby extracting autocorrelation coefficients of 10th order. In this case, the number of poles to be extracted can be the number properly representing the poles included in the basic analysis frames. In this embodiment, the number of poles included in the basic analysis frame is 5. These five poles are calculated by utilizing the following feature of the denominator $A_p(Z^{-1})$ of equation (2). Solutions of $A_p(Z^{-1})$ can be easily obtained when the following quadratic equation is given:

$$A_p(Z^{-1})=1+\alpha_1 Z^{-1}+\alpha_2 Z^{-2}$$

It is also apparent that the solutions are always present.

This embodiment is based on this assumption. Calculations of the LPC coefficients of 2nd order continues until the 2nd-order LPC coefficients of the last stage are calculated. As a result, the pole frequency data of the extracted LPC coefficients of 2nd order and its bandwidth data are obtained.

The LPC analyzer 34-1 receives 10th-order autocorrelation coefficients $\rho_0^{(0)}$ to $\rho_{10}^{(0)}$ and extracts LPC coefficients $\alpha_i^0$ (i=1, 2). These extracted coefficients are supplied to the autocorrelation region inverse filter 35-1 and the pole calculator 36-1. The autocorrelation coefficients $\rho_0^{(0)}$ to $\rho_{10}^{(0)}$ of 10th order correspond to the delay times of 0 to 10 times the sampling period, respectively. Number (0) of the autocorrelation coefficient corresponds to the number of times filtering by the autocorrelation region inverse filter is performed.

The autocorrelation region inverse filter 35-1 uses the LPC coefficients $\alpha_i^{(0)}$ (i=1, 2) and has a frequency characteristics of the autocorrelation region which is inverse to that of the spectral envelope of input speech for each basic analysis frame. In this case, only the inverse characteristic derived using the LPC coefficients $\alpha_i^{(0)}$ of 2nd order is extracted. Therefore, the autocorrelation coefficients $\rho_0^{(0)}$ to $\rho_{10}^{(10)}$ of 10th order supplied to the filter 35-1 are generated as the autocorrelation coefficients $\rho_0^{(1)}$ to $\rho_8^{(1)}$ of 8th order, from which the 9th and 10th orders are eliminated. Number (1) corresponds to the number of times reverse filtering is performed.

Auto-correlation region inverse filtering is performed in the following manner. Before inverse filtering is described, however, the basic 2nd-order LPC coefficient extraction operation will be described. If a sampled value of input speech is given as $x_i$ ($i=-\infty, \ldots 0, \ldots +\infty$), an autocorrelation coefficient with delay time j is given as follows:

$$\rho_j^{(0)} = \sum_{-\infty}^{\infty} x_i x_{i-j} \tag{3}$$

The prediction of input speech is expressed by 2nd-order linear prediction coefficients $\alpha_1^{(1)}$ and $\alpha_2^{(0)}$, and $X_i$ and $\rho_j^{(0)}$ are given by equations (4) and (5), respectively:

$$x_i=\alpha_1^{(0)}x_{i-1}+\alpha_2^{(0)}x_{i-2}+\epsilon_i \tag{4}$$

where $\epsilon_i$ is the prediction residual difference waveform; and $$\begin{aligned}\rho_j^{(0)} &= \sum_{i=-\infty}^{\infty} (\alpha_1^{(0)} x_{i-1} + \alpha_2^{(0)} x_{i-2} + \epsilon_i)\, x_{i-j} \\ &= \sum_{i=-\infty}^{\infty} \alpha_1^{(0)} x_{i-1} x_{i-j} + \sum_{i=-\infty}^{\infty} \alpha_2^{(0)} x_{i-2} x_{i-j} + \\ &\quad \sum_{i=-\infty}^{\infty} \epsilon_i x_{i-j} \\ &\approx \alpha_1^{(0)} \rho_{j-1}^{(0)} + \alpha_2^{(0)} \rho_{j-2}^{(0)}\end{aligned} \tag{5}$$

wherein the underlined term is substantially zero.

The coefficient matrix in equation (6) can be performed to easily calculate LPC coefficients $\alpha_i^{(0)}$ (i=1, 2):

$$\begin{bmatrix} \rho_0^{(0)} & \rho_{-1}^{(0)} \\ \rho_1^{(0)} & \rho_0^{(0)} \end{bmatrix} \cdot \begin{bmatrix} \alpha_1^{(0)} \\ \alpha_2^{(0)} \end{bmatrix} = \begin{bmatrix} \rho_0^{(0)} & \rho_1^{(0)} \\ \rho_1^{(0)} & \rho_0^{(0)} \end{bmatrix} \cdot \begin{bmatrix} \alpha_1^{(0)} \\ \alpha_2^{(0)} \end{bmatrix} = \begin{bmatrix} \rho_1^{(0)} \\ \rho_2^{(0)} \end{bmatrix} \tag{6}$$

A waveform (i.e., the residual difference waveform) filtered through the inverse filter obtained by using the LPC coefficients $\alpha_i^{(0)}$ (i=1, 2) is given by $e_i$ in equation (7):

$$e_i = x_i - \alpha_1^{(0)} x_{i-1} - \alpha_2^{(0)} x_{i-2} (i = -\infty \text{ to } +\infty) \tag{7}$$

The autocorrelation coefficient $\rho_j^{(1)}$ of $e_i$ can be calculated by using the coefficient $\rho_j^{(0)}$ of the input speech waveform and the LPC coefficients obtained by equation (5) in the following manner.

If $y_i = x_i$ (= $-\infty$ to $+\infty$), $\rho_j^{(1)}$ is expressed as:

$$\begin{aligned}\rho_j^{(1)} &= \sum_{i=-\infty}^{\infty} e_i \cdot e_{i-j} \\ &= \sum_{i=-\infty}^{\infty} (x_i - \alpha_1^{(0)} x_{i-1} - \alpha_2^{(0)} x_{i-2}) \cdot \\ &\quad (y_{i-j} - \alpha_1^{(0)} y_{i-j-1} - \alpha_2^{(0)} y_{i-j-2}) \\ &= -\alpha_2^{(1)} \sum_{i=-\infty}^{\infty} x_{i-2} y_{i-j} + (\alpha_1^{(0)} \cdot \alpha_2^{(0)} - \alpha_1^{(0)}) + \\ &\quad \sum_{i=-\infty}^{\infty} x_{i-1} y_{i-j} + (1 + \alpha_1^{(0)})^2 + (\alpha_2^{(0)})^2 + \\ &\quad \sum_{i=-\infty}^{\infty} x_i y_{i-j} + (\alpha_1^{(0)} \cdot \alpha_2^{(0)} - \alpha_1^{(0)}) + \\ &\quad \sum_{i=-\infty}^{\infty} x_i y_{i-j-1} - \alpha_2^{(0)} \sum_{i=-\infty}^{\infty} x_i y_{i-j-2} \\ &= -\alpha_2^{(0)} \rho_{j-2}^{(0)} + \alpha_1^{(0)} (\alpha_2^{(0)} - 1) \rho_{j-1}^{(0)} + (1 + \\ &\quad (\alpha_1^{(0)})^2 + (\alpha_2^{(0)})^2) \rho_j^{(0)} + \alpha_1^{(0)} (\alpha_2^{(0)} - \\ &\quad 1) \rho_{j+1}^{(0)} - \alpha_2^{(0)} \rho_{j+2}^{(0)}\end{aligned} \tag{8}$$

and the matrix calculation in equation (9) can be performed:

$$\begin{bmatrix} \rho_2^{(0)} & \rho_1^{(0)} & \rho_0^{(0)} & \rho_1^{(0)} & \rho_2^{(0)} \\ \rho_1^{(0)} & \rho_0^{(0)} & \rho_1^{(0)} & \rho_2^{(0)} & \rho_3^{(0)} \\ \rho_0^{(0)} & \rho_1^{(0)} & \rho_2^{(0)} & \rho_3^{(0)} & \rho_4^{(0)} \\ \cdot & \cdot & \cdot & \cdot & \cdot \\ \cdot & \cdot & \cdot & \cdot & \cdot \\ \cdot & \cdot & \cdot & \cdot & \cdot \\ \rho_{j-2}^{(0)} & \rho_{j-1}^{(0)} & \rho_j^{(0)} & \rho_{j+1}^{(0)} & \rho_{j+2}^{(0)} \end{bmatrix} \tag{9}$$

-continued $$\underbrace{\begin{bmatrix} \rho_{j-1}^{(0)} & \rho_j^{(0)} & \rho_{j+1}^{(0)} & \rho_{j+2}^{(0)} & \rho_{j+3}^{(0)} \\ \cdot & \cdot & \cdot & \cdot & \cdot \\ \cdot & \cdot & \cdot & \cdot & \cdot \\ \cdot & \cdot & \cdot & \cdot & \cdot \\ \rho_{j+k-2}^{(0)} & \rho_{j+k-1}^{(0)} & \rho_{j+k}^{(0)} & \rho_{j+l+1}^{(0)} & \rho_{j+l+2}^{(0)} \end{bmatrix}}_{\leftarrow A \rightarrow} \underbrace{\begin{bmatrix} -\alpha_2^{(0)} \\ \alpha_1^{(0)} (\alpha_2^{(0)} - 1) \\ 1 + (\alpha_1^{(0)})^2 + (\alpha_2^{0})^2 \\ \alpha_1^{(0)} (\alpha_2^{(0)} - 1) \\ -\alpha_2^{(0)} \end{bmatrix}}_{\leftarrow B \rightarrow} = \underbrace{\begin{bmatrix} \rho_0^{(0)} \\ \rho_1^{(0)} \\ \rho_2^{(0)} \\ \cdot \\ \cdot \\ \cdot \\ \rho_j^{(1)} \\ \rho_{j+1}^{(1)} \\ \rho_{j+k}^{(1)} \end{bmatrix}}_{\leftarrow C \rightarrow}$$

$\rho_j^{(1)}$ can be calculated by equation (8). The order of the autocorrelation coefficients is (j+k), which is two orders lower than the order of the input coefficients. The autocorrelation coefficient matrix represented by A are filtered through a transversal digital filter using the respective elements represented by B to obtain the autocorrelation coefficients represented by C. The autocorrelation coefficients $\rho_2^{(0)}$, $\rho_1^{(0)}$, $\rho_0^{(0)}$, $\rho_1^{(0)}$, and $\rho_2^{(0)}$ are sequentially applied to the digital filter using the coefficients represented by B to provide a sum as $\rho_{(0)}^{(1)}$ of C.

The resultant $\rho_j^{(1)}$ is used to calculate the LPC coefficients $\alpha_i^{(1)}$ (i=1, 2) which are then used to calculate $\rho_j^{(2)}$. This operation is repeated to finally obtain $\alpha_i^{(n/2-1)}$ (i=1, 2) where n is a maximum value of $\rho_j^{(0)}$ (j=0, 1, 2, . . . n).

In this embodiment, since n=10, the operations for calculating $\alpha_i^{(n/2-1)}$ are given as follows:

(1) $\rho_j^{(0)}$ (j=0, 1, 2, . . . 10) is calculated using equation (3).

(2) $\alpha_i^{(0)}$ (i=1, 2) is calculated using equation (5).

(3) $\rho_j^{(1)}$ (j=0, 1, 2, . . . 8) is calculated using equation (8).

(4) $\alpha_i^{(1)}$ (i=1, 2) is calculated using equation (5). In this case, (0) is substituted by (1).

(5) $\rho_j^{(2)}$ (j=0, 1, 2, . . . 6) is calculated using equation (8). In this case, (0) and (1) are substituted by (1) and (2).

(6) $\alpha_i^{(2)}$ (i=1, 2) is calculated using equation (5). In this case, (0) is substituted by (2).

(7) $\rho_j^{(3)}$ (j=0, 1, 2, 3, 4) is calculated using equation (8). In this case, (0) and (1) are substituted by (2) and (3).

(8) $\alpha_i^{(3)}$ (i=1, 2) is calculated by using equation (5). In this case, (0) is substituted by (3).

(9) $\rho_j^{(4)}$ (j=0, 1, 2) is calculated using equation (8). In this case (0) and (1) are substituted by (3) and (4).

(10) $\alpha_i^{(4)}$ (i=1, 2) is calculated using equation (5). In this case, (0) is substituted by (4).

Referring to FIG. 2, when the 10th-order autocorrelation coefficients $\rho_0^{(0)}$ to $\rho_{10}^{(0)}$ (i.e , n=10) are supplied to the five (=n/2) LPC analyzers 34-1 to 34-5 and the four (=n/2−1) autocorrelation region inverse filters 35-1 to 35-4, the analyzers 34-1 to 34-5 and the filters 35-1 to 35-4 perform the above processing, so that outputs $\rho_0^{(1)}$ to $\rho_8^{(1)}$, $\rho_0^{(2)}$ to $\rho_6^{(2)}$, $\rho_0^{(3)}$ to $\rho_4^{(3)}$, and $\rho_0^{(4)}$ to $\rho_2^{(4)}$ appear at the filters 35-1, 35-2, 35-3 and 35-4, respectively. The second-order LPC coefficients $\alpha_i^{(0)}$, $\alpha_i^{(1)}$, $\alpha_i^{(2)}$, $\alpha_i^{(3)}$ and $\alpha_i^{(4)}$ (i=1, 2) appear at outputs of the analyzers 34-1, 34-2, 34-3, 34-4, and 34-5, respectively.

The autocorrelation coefficients appearing from the filter 35-4 are $\rho_0^{(4)}$ to $\rho_2^{(4)}$. More autocorrelation coefficients are apparently unnecessary. Therefore, the output devices for the autocorrelation coefficient sequence can be constituted by only the autocorrelation coefficient calculator 33 for generating the autocorrelation coefficient sequence of a given order covering the delay times and the four autocorrelation region inverse filters 35-1 to 35-4 for decreasing each of the orders by two orders and finally generating the autocorrelation coefficients of second order.

Five sets of second-order LPC coefficients $\alpha_i^{(0)}$, $\alpha_i^{(1)}$, $\alpha_i^{(2)}$, $\alpha_i^{(3)}$ and $\alpha_i^{(4)}$ are supplied to the pole calculators 36-1, 36-2, 36-3, 36-4, and 36-5, respectively. Each pole calculator calculates a pole center frequency determined corresponding to its LPC coefficient of second order and its bandwidth in the following manner. Assume that the calculated LPC coefficient is $\alpha_i^{(l)}$ (i=1, 2). An equation for setting the denominator of equation (2) which is expressed by these LPC coefficients of second order is given below:

$$1+\alpha_1^{(l)}Z^{-1}+\alpha_2^{(l)}Z^{-2} \tag{10}$$

Equation (10) is a quadratic equation with real coefficients and generally has conjugate complex roots represented by equation (11) below:

$$Z^{-1} = \left(-\alpha_1^{(l)} \pm \sqrt{4\alpha_2^{(l)} - (\alpha_1^{(l)})^2} \cdot \sqrt{-1}\right)/2 \tag{11}$$

Equation (10) can be rewritten as equation (12), and its roots can be given as equation (13):

$$\alpha_2^{(l)} = \alpha_1^{(l)} Z + Z^2 = 0 \tag{12}$$

$$Z = \left(-\alpha_1^{(l)} \pm \sqrt{4\alpha_2^{(l)} - (\alpha_1^{(l)})^2} \cdot \sqrt{-1}\right)/2\alpha_2^{(l)} \tag{13}$$

A pair of conjugate complex roots expressed by equation (13) are given below:

$$Z=re^{j\theta},\ Z=re^{-j\theta} \tag{14}$$

Z can also be rewritten as follows:

$$Z=e^{ST}=e^{(-n+j\omega)T}=e^{-nT}e^{j\omega T}=re^{j\phi} \tag{15}$$

therefore, the pole frequency f and a bandwidth b are derived as follows:

$$f=\omega/2\pi=(\tfrac{1}{2}\pi)(1/T)arg(Z)\ (Hz) \tag{16}$$

$$b=(1/\pi)\cdot(1/T)|logr| \tag{17}$$

The above contents are described in detail in any reference book for the fundamentals of speech data processing. Therefore, the pole calculators 36-1 to 36-5 generate five pairs of pole frequencies and bandwidths $f_0$ and $b_0$, $f_1$ and $b_1$, $f_2$ and $b_2$, $f_3$ and $b_3$, $f_4$ and $b_4$, and $f_5$ and $b_5$. These sets of data are supplied to a band separator 37.

The band separator 37 separates a pole frequency and bandwidth pair which exceeds a predetermined bandwidth (i.e., a broad bandwidth) from a pair which does not exceed the predetermined bandwidth (i.e., a narrow bandwidth). The elements of the broad bandwidth group and the narrow bandwidth group are thus respectively reordered. The reordered elements of these groups are supplied to a pattern label selector 39 through lines L11 and L12.

The band separation of the band separator 37 will be described below. Assume that the pairs $f_0$ and $b_0$, and $f_3$ and $b_3$ belong to the broad bandwidth group, and that the paris $f_1$ and $b_1$, $f_2$ and $b_2$, and $f_4$ and $b_4$ belong to the narrow bandwidth group. Also assume that the frequencies of the narrow bandwidth group satisfy condition $f_2 < f_1 < f_4$, and the frequencies of the broad bandwidth group satisfy condition $f_3 < f_0$. The pole frequency and bandwidth pairs of the narrow bandwidth group are thus rearranged in an order of $(f_2,b_2)$, $(f_1,b_1)$ and $(f_4,b_4)$. The pole frequency and bandwidth pairs of the broad bandwidth group are rearranged in an order of $(f_3,b_3)$ and $(f_0,b_0)$.

Band separation processing is expressed in a general format to derive equations (18) and (19) for the narrow and broad bandwidth groups generated by the band separator 39, respectively:

$$(F_p^{N(1)},B_p^{N(1)}),\ (F_p^{N(2)}),B_p^{N(2)}),\ \ldots,\ (F_p^{N(M)},B_p^{N(M)}) \tag{18}$$

$$(F_p^{B(1)},B_p^{B(1)}),(F_p^{B(1)},B_p^{B(2)}),\ \ldots,\ (F_p^{B(Q-M)},B_p^{B(Q-M)}) \tag{19}$$

where $F_p$ and $B_p$ are the pole frequency and bandwidth of each analysis frame of input data, N is the broad bandwidth group, B is the narrow bandwidth group, Q is a total pole number, and M is the number of pairs belonging to the narrow bandwidth group arranged in the order from a lower frequency to a higher frequency, i.e., (1), (2), . . . (M), and (Q-M). In the embodiment of FIG. 2, Q=5 is given. If M pairs belong to the narrow bandwidth group, the number of pairs belonging to the broad bandwidth group is (5-M). Therefore, M and (5-M) pairs are independently supplied to the pattern label selector 39.

The predetermined frequency for determining the narrow bandwidth is given as a frequency for separating the narrow bandwidth preset under a condition including a bandwidth of a pole frequency according to a large amount of speech information from the broad bandwidth, excluding the preset narrow bandwidth. The pattern label selector 39 receives the data output from the band separator 37 and calculates a weighted sum of the squares of differences between the input data vectors and a plurality of reference pattern vectors in units of analysis frames. The pattern label selector 39 then selects a label of the reference pattern that minimizes the weighted sum.

The memory in the analysis unit is used as a reference pattern memory 38. Alternatively, an analyzer having substantially the same pole frequency and bandwidth extraction function as the analyzer unit is used to off-line process the reference speech information prepared according to the application purpose. The pole frequencies and bandwidths of the respective basic analysis frames are extracted, and the extracted pairs of data are classified into the narrow and broad bandwidth groups. In each group, the pairs are reordered from the lower to the higher pairs. The rearranged pairs are then stored as the reference pattern in the memory 38.

In the pattern label selector 39, vector elements consist of a pole frequency belonging to the narrow bandwidth group, a pole frequency belonging to the broad bandwidth group, a bandwidth belonging to the narrow bandwidth group, and a bandwidth belong to the broad bandwidth group. For each vector element, a weighted sum of differences between the input data vectors and the reference pattern vectors for the respective basic analysis frames are calculated. A sum of the four weighted sums for the vector elements is given as a spectral distortion, which serves as a matching measure in pattern matching. D in equation (20) is the spectral distortion:

$$D = \sum_{i=1}^{M} W_i^{(FN)} (F_k^{N(i)} - F_p^{N(i)})^2 + \sum_{i=1}^{M} W_i^{(BN)} (B_k^{N(i)} - B_p^{N(i)})^2 + \sum_{i=1}^{5-M} W_k^{(FW)} (F_k^{B(i)} - B_p^{B(i)})^2 + \sum_{i=1}^{5-M} W_i^{(BW)} (B_k^{B(i)} - B_p^{B(i)})^2 \quad (20)$$

where $F_k$ and $F_p$ are the pole frequencies of the reference pattern and input data, $B_k$ and $B_p$ are the bandwidths of the pole frequencies of the reference pattern and input data, N is the narrow bandwidth group, B is the broad bandwidth group, $W_i^{(FN)}$ and $W_i^{(BN)}$ are the weighting coefficients for the square of the difference between the reference pattern and input data, in association with the pole frequency and bandwidth of a pair belonging to the narrow bandwidth group, and $W_i^{(FW)}$ and $W_i^{(BW)}$ are the weighting coefficients for the square of the difference between the reference pattern and input data, in association with the pole frequency and bandwidth of a pair belonging to the broad bandwidth group, the weighting coefficients being prestored in a weighting coefficient memory 40. In this embodiment, the weighting coefficients are prepared for squaring the differences for $i=1$ to M in the narrow bandwidth and for $i=1$ to (5-M) in the broad bandwidth. However, the four weighting coefficients may be represented by a single weighting coefficient according to the application of the pattern matching vocoder.

A predetermined weighting coefficient is read out from the coefficient memory 40 for weighting every square of the difference between the reference pattern and the input data in units of vector elements. By using the weighted squared values, the spectral distortions D in equation (20) are calculated. A reference pattern with a minimum spectral distortion is selected as the optimal reference pattern. Spectral distortion evaluation can be optimized in matching the reference pattern vector and the spectral envelope parameter vector converted to the pole center frequency and bandwidth.

The label data of the selected reference pattern is supplied then to a multiplexer 44.

The pitch extractor 11, the voiced/unvoiced/silent discriminator 12 and the power calculator 13 extract the pitch data as the exciting source data, the data for discriminating a voiced sound, an unvoiced sound, and silence, and the power data representing the intensity of the exciting source, according to known extraction schemes, and supply them to the multiplexer 44.

The multiplexer 44 multiplexes the input data in a properly combined format and sends it to the synthesizer unit through a transmission line L13.

Figure 3:
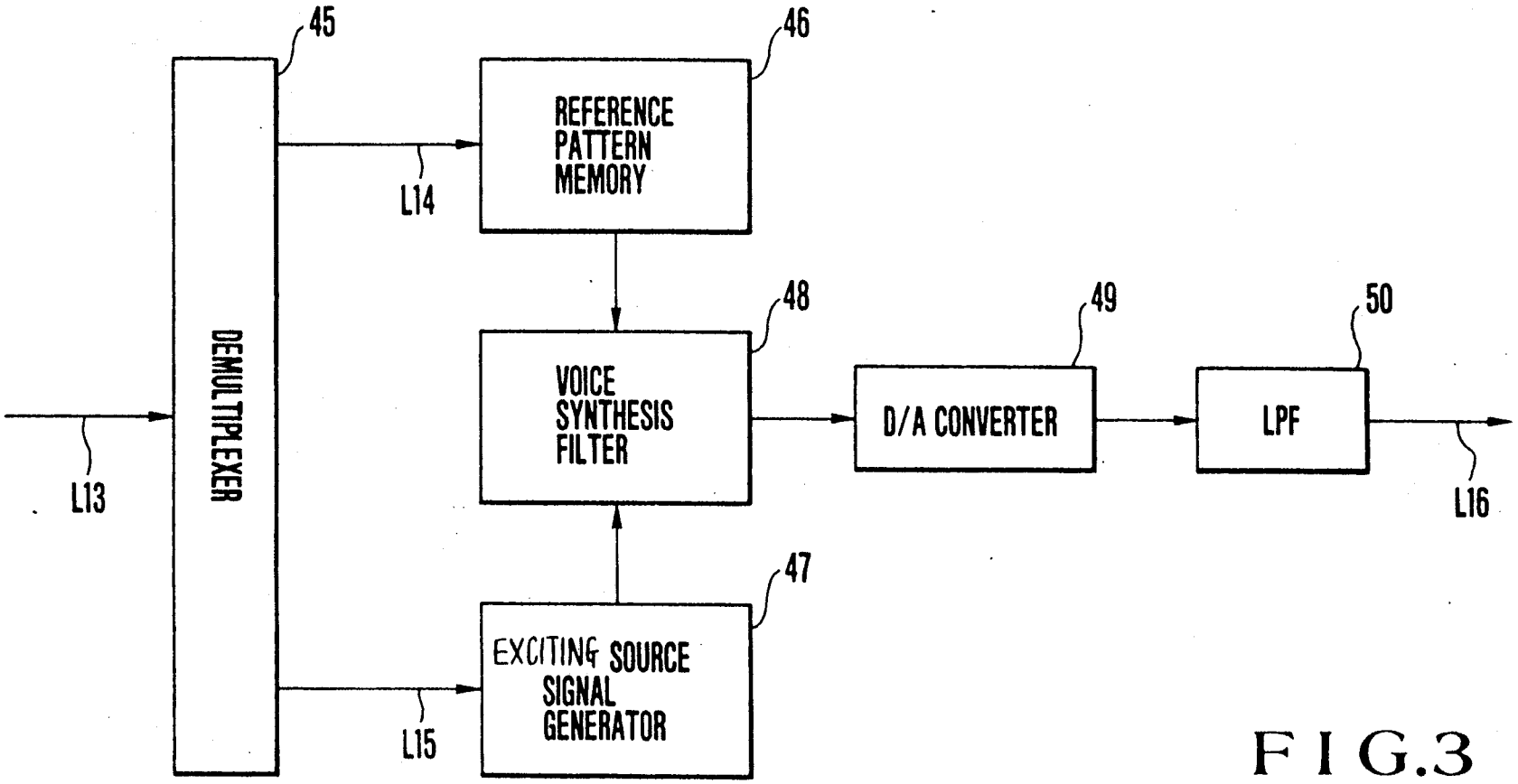
FIG. 3 is a block diagram of a synthesizer unit in the vocoder shown in FIG. 2.

FIG. 3 shows a synthesizer unit corresponding to the analyzer unit of FIG. 2. In the synthesizer unit, the multiplexed data is received by a demultiplexer 45 through the transmission line L13. The pattern label data is then supplied to a reference pattern memory 46 through a line L14. The pitch data, the voiced/unvoiced/silent discrimination data and the power data are supplied to an exciting source signal generator 47 through a line L15. Any LPC coefficient or its derivative can be stored in the reference pattern memory 46 if the data read out in response to the input pattern label data is a feature parameter which is able to express the spectral envelope of each basic analysis frame of the input speech signal throughout the entire frequency band. A plurality of reference patterns obtained under the above condition are stored in the reference pattern memory 46. In this embodiment, the reference patterns are registered using parameters obtained by analyzing speech information with a predetermined order in a basic analysis frame period. The exciting source signal generator 47 generates the exciting source signal by using the pitch data, the voiced/unvoiced/silent discrimination data, and the power data in the following manner.

When the discrimination data represents a voiced or unvoiced sound, a pulse with a repetition period corresponding to the pitch data is generated. However, when the discrimination data represents silence, white noise is generated. The pulse or white noise is then supplied to a variable gain amplifier. The gain of the variable gain amplifier is changed in proportion to the power data, thereby generating the exciting source signal, as is well known to those skilled in the art. The speech sound is reproduced in units of basic analysis frames and is supplied to a voice synthesis filter 48.

The voice synthesis filter 48 constituting an all-pole digital filter has the same order as that of the spectral envelope feature parameter of the reference pattern stored in the reference pattern memory 46. The filter 48 receives the parameter as the filter coefficient from the reference pattern memory 46 and the exciting source signal from the exciting source signal generator 47. The filter 48 then reproduces the digital speech signal in units of basic analysis frame periods. The reproduced digital speech signal is supplied to a D/A converter 49. The D/A converter 49 converts the input digital speech signal to an analog speech signal. The analog speech signal is then supplied to an LPF 50. The LPF 50 eliminates an unnecessary high-frequency component of the analog speech signal. The resultant signal appears as an output speech signal on an output line L16.

In the above embodiment, there is provided a pattern matching vocoder wherein the input speech spectral envelope is expressed by a set of a plurality of pole frequencies and bandwidths, and the spectral distortion evaluation in pattern matching between reference pattern vectors and analysis parameter vectors can be optimized.

In the above embodiment, the exciting source information may comprise a waveform transmission of, e.g., a multipulse or a residual difference vibration in the same manner as in the embodiment of FIG. 1. In the above embodiment, analysis and synthesis of a fixed length frame period for each basic analysis frame are assumed. However, analysis and synthesis of a variable length frame period can be performed.

In addition, the number of poles including the pole frequencies can be arbitrarily set in accordance with the application and the contents of input speech.

Figure 4:
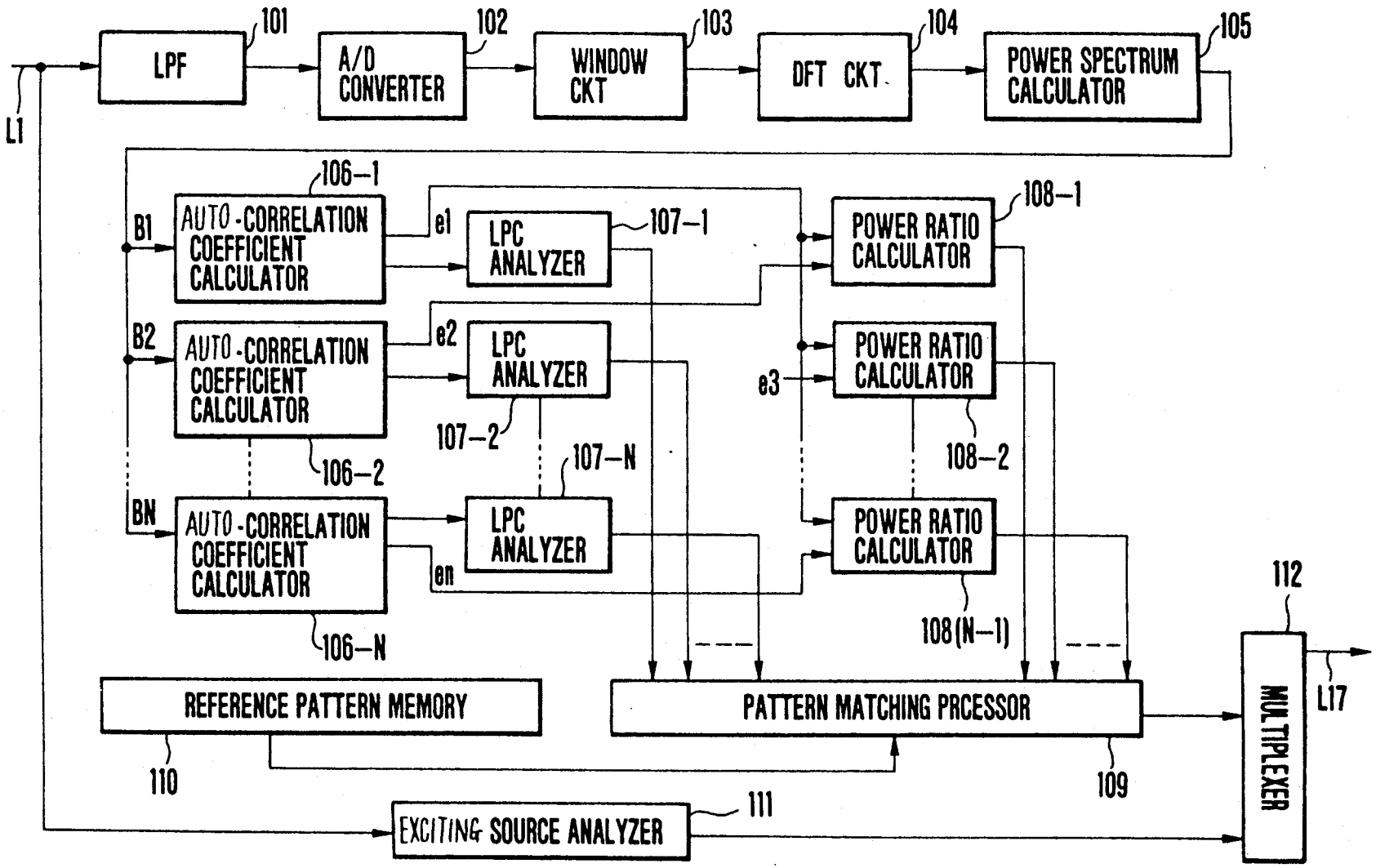
FIG. 4 is a block diagram of a pattern matching vocoder according to still another embodiment of the present invention.

FIG. 4 shows an analysis unit of a pattern matching vocoder according to still another embodiment of the present invention. Referring to FIG. 4, an unnecessary high-frequency component of an input speech signal from an input line L1 is eliminated by an LPF 101. A cut-off frequency is set to be 3,333 kHz. An output from the LPF 101 is converted by an A/D converter 102 at an 8-kHz sampling frequency to a digital signal of a predetermined number of bits. This digital signal is then supplied to a window circuit 103.

The window circuit 103 performs window processing for assigning the Hamming coefficient to each 32-msec of the input signal. Thereafter, 256-point discrete Fourier transform (DFT) is performed by a DFT circuit 104. An output from the DFT circuit 104 is a complex spectral component in the frequency region. The complex spectral component is then squared by a power spectrum calculator 105, so that the frequency vs power spectrum can be calculated. An output from the power spectrum calculator 105 is then supplied, after band-splitting, to autocorrelation coefficient calculators 106-1 to 106-N. The calculators 106-1 to 106-N have a number N corresponding to the number of divisions and the divided frequency regions, and bandwidths B1, B2, . . . BN (B1 < B2 . . . < BN). In this embodiment, autocorrelation functions are calculated for the frequencies of the N divided frequency regions of the frequency range of 0 to 3,333 kHz. The division number and the divided frequency regions are determined by speech information such that formant frequencies are respectively included.

The autocorrelation coefficient calculators 106-1 to 106-N receive the outputs from the power spectrum calculator 105 for the divided frequency regions and perform an inverse DFT to calculate autocorrelation coefficients at respective delay times within each range. The resultant autocorrelation coefficients are then supplied to corresponding LPC analyzers 107-1 to 107-N. The autocorrelation coefficients at a zero delay time, i.e., short-time average powers $e_l$ to $e_n$, are selectively supplied to (N-1) power ratio calculators 108-1 to 108-(N-1), thereby calculating the ratios of the short-time average powers between respective frequency regions. In this embodiment, the short-time average power ratios are calculated on the basis of the short-period average power $e_l$. The powers $e_1$ and $e_2$ are supplied to the calculator 108-1, the powers $e_1$ and $e_3$ are supplied to the calculator 108-2, and so on until finally, $e_l$ and $e_n$ are supplied to the calculator 108-(N-1), thereby causing the (N-1) calculators 108-1 to 108-(N-1) to calculate the power ratios between the frequency regions. However, $e_1$ and $e_2$, $e_2$ and $e_3$, . . . and $e_{(n-1)}$ and $e_n$ may be respectively supplied to the power ratio calculators 108-1 to 108-(N-1).

The LPC analyzers 107-1 to 107-N process the input autocorrelation coefficients, using a known processing scheme such as autocorrelation method, and extract a predetermined number of LPC coefficients (in this embodiment, K parameters of 8th order, i.e., partial correlation coefficients). The extracted coefficients are then supplied to a pattern matching processor 109.

The calculated power ratios are supplied from the power ratio calculators 108-1 to 108-(N-1) to the pattern matching processor 109. In other words, the K parameters and the power ratios of the respective frequency regions are supplied to the pattern matching processor 109.

A reference pattern memory 110 prepares the K-parameter reference pattern file, classified corresponding to the N divisions, by using the vocoder or another computer operated to process speech information in an off-line manner. In this embodiment, the K parameters of the 8th order are prepared in the pattern file in divided frequency regions. The power ratios between the divided frequency regions are also prepared in the pattern file. Pattern matching is performed by LPC analysis for each frequency region by using the K parameters calculated by LPC analysis and the power ratios between the frequency regions as vector elements of the spectral envelope. In this pattern matching between the two patterns, the spectral distances measured between all K parameters included in these patterns serve as measurement standards. The shortest spectral distance between each frequency regions is selected as a reference pattern for each frequency region. In this case, continuity of the spectrum expressed by the K parameters between the frequency regions is checked by the power ratios therebetween. In other words, the vector elements, as the power ratios between the frequency regions, are used as sole parameters. Pattern matching is thus performed while the power ratios are added to the vector elements to guarantee continuity between the frequency regions.

Reference pattern number designation data for each reference pattern, selected by pattern matching in units of frequency regions, is then supplied to a multiplexer 112.

An exciting source data analyzer 111 and the multiplexer 112 are operated in the same manner as in the embodiment of FIG. 1.

The synthesizer unit corresponding to the analyzer unit of FIG. 4 has the same arrangement as in FIG. 3. In this case, a reference pattern memory 46 may store any LPC coefficients or their derivatives only if the data signals read out in response to the input reference pattern number designation data are feature parameters expressing the spectral envelope of the input speech signal throughout the entire frequency band. However, it should be noted that the vector elements representing the spectral envelope of all frequency regions are not discontinuous between the frequency regions.

In this embodiment, the K parameters for the entire frequency band subjected to 18th-order analysis are used to express vector elements for all frequency regions constituting the frequency band. However, the K parameters may be other LPC coefficients, such as $\alpha$ parameters. The order of the LPC coefficients is determined by expressing all vector elements throughout the entire frequency band without difficulty. The operation of this embodiment is the same as that of FIG. 3. In this embodiment, LSP coefficients may be used as linear prediction coefficients. More specifically, LSP coefficients are extracted as linear prediction coefficients in units of frequency regions. At the same time, spectral distance measurements are performed and reference patterns to be matched utilize the vector elements as LSP coefficients. In addition, the LPC coefficients filed to express vector elements throughout all frequency regions in the synthesizer unit are prepared by using LSP coefficients of 18th order. Other basic operations are substantially the same as those in the above embodiment.

Figure 5:
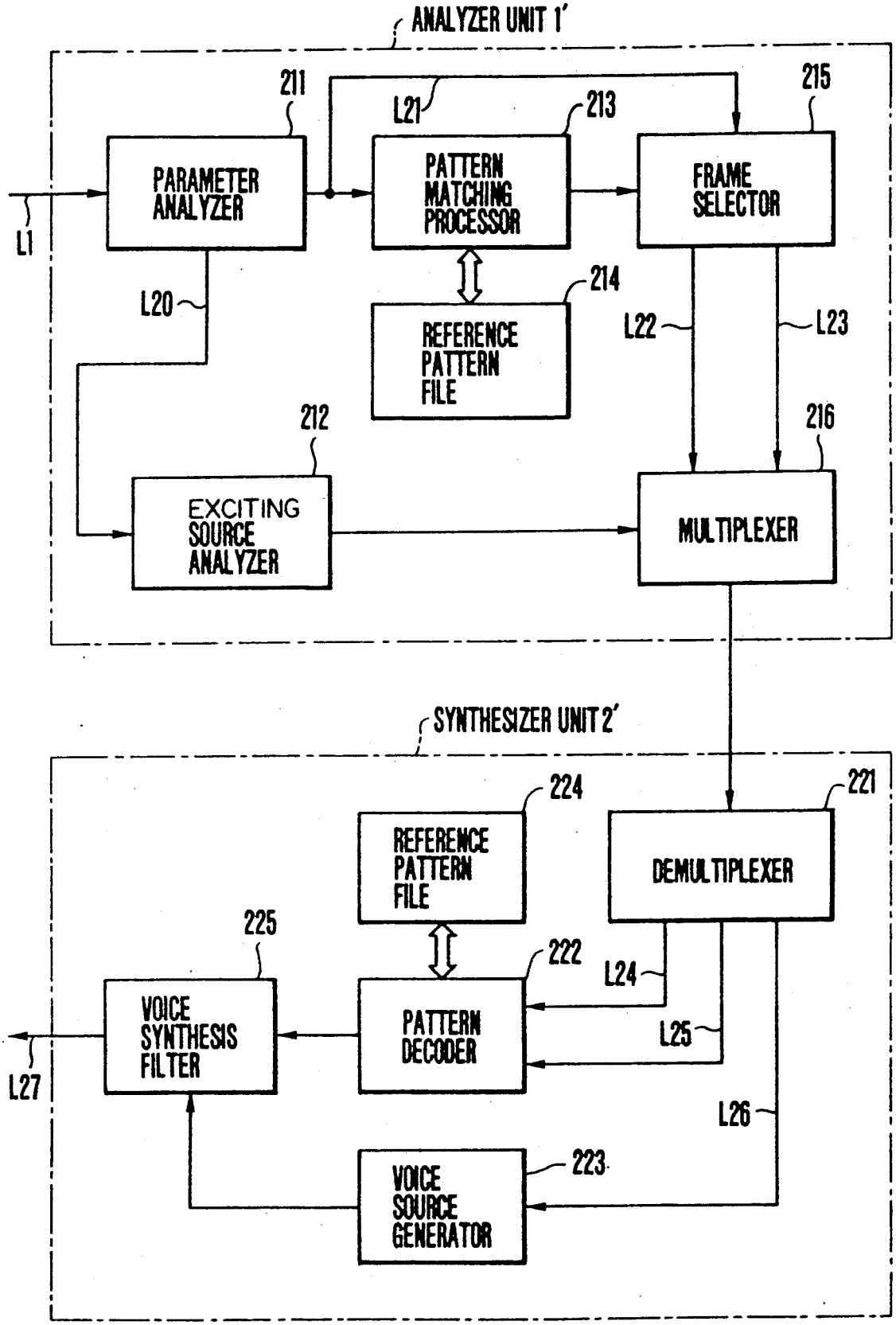
FIG. 5 is a block diagram of a pattern matching vocoder according to still another embodiment of the present invention.

FIG. 5 shows still another embodiment of the present invention. A pattern matching vocoder of this embodiment comprises an analyzer unit 1' and a synthesizer unit 2'. The analyzer unit 1' includes a parameter analyzer 211, an exciting source analyzer 212, a pattern matching processor 213, a reference pattern file 214, a frame selector 215 and a multiplexer 216 The synthesizer unit 2' includes a demultiplexer 221, a pattern decoder 222, an exciting source generator 223, a reference pattern file 224, and a voice synthesis filter 225.

A speech signal input through an input line L1 is supplied to the parameter analyzer 211. The parameter analyzer 211 uses LSP in this embodiment However, LSP may be replaced with LPC effective for pattern matching. An unnecessary high-frequency component of the input speech signal is eliminated by a low-pass filter with a 3.4-kHz cut-off frequency. An output from the LPF is converted by an analog-to-digital converter at an 8-kHz sampling frequency to a digital signal of a predetermined number of bits. The digital signal is then subjected to multiplication with a predetermined window function, and is supplied to the exciting source analyzer 212 through a line L20. This operation is performed in the following manner. 30-msec components of the digital signal are stored in a built-in memory and are read out therefrom at 10-msec intervals, thereby performing window processing with the Hamming coefficient and hence outputting 10-msec analysis frames. 20 successive analysis frames, i.e., 200 msec, are defined as one section. The digital speech signal of each analysis frame is then subjected to LPC analysis, so that an LSP coefficient sequence of a predetermined order is obtained. The resultant LSPs are supplied through a line L21 to the pattern matching processor 213 and a frame selector 215.

The pattern matching processor 213 matches LSP spectral envelope parameter patterns, input in units of sections and analysis frames, with LSP spectral envelope parameter reference patterns stored in the reference pattern file 214 to select optimal spectral envelope reference patterns. The optimal spectral envelope reference pattern has a minimum spectral distance between these two patterns, as given in equation (1). The minimum spectral distance is defined as follows:

$$D_Q^{(q)} = \min \begin{cases} \sum_{K=1}^{N} W_k (P_k^{(Q)} - P_k^{(S1)})^2 \\ \sum_{K=1}^{N} W_k (P_k^{(Q)} - P_k^{(S2)})^2 \\ \cdot \\ \cdot \\ \cdot \\ \sum_{K=1}^{N} W_k (P_k^{(Q)} - p_k^{(SR)})^2 \\ \sum_{K=1}^{N} W_k (P_k^{(Q)} - P_k^{(SM)})^2 \end{cases} \quad (21)$$

where $W_k$ is the spectral sensitivity, N is the order of LSPs, $P_k^{(Q)}$ is the spectral envelope patterns of the analysis frames of each section, Q takes consecutive numbers of the analysis frames of each section, and Q=1 to 20 in this embodiment. R=1 to M where M is the total number of spectral reference patterns, and $P_k^{(S1)}$ to $P_k^{(SM)}$ are first to Mth spectral envelope reference patterns.

The M spectral envelope reference patterns obtained by equation (21) and the spectral envelope patterns of the analysis frames of each section are subjected to LSP analysis and pattern matching. The minimum distance $D_Q^{(q)}$ is selected as the reference pattern. A code for designating the selected reference pattern and $D_Q^{(q)}$ are then supplied as label data and a quantization distortion to the frame selector 215. $D_Q^{(q)}$ represents a spectral distance between the two patterns and is a spectral distortion, i.e., a quantization distortion or a pattern matching distortion.

The frame selector 215 receives LSPs from the parameter analyzer 211 and selects a representative analysis frame for performing variable length framing of each section according to rectangular approximation using a DP technique. According to rectangular approximation, a predetermined number of representative analysis frames are selected from the analysis frames of each section. These representative analysis frames represent all analysis frames in that section. The representative analysis frames are selected to constitute a rectangular function for approximating the reference parameters to the spectral envelope parameters of the input speech signal in units of sections.

In this embodiment, the variable length frame is determined by setting an optimal function for each section (i.e., 200 msec constituted by 20 10-msec analysis frames). This section is expressed by five representative analysis frames and repeat data thereof. In other words, the section is expressed by a combination of the five selected representative analysis frames and analysis frames assigned to the respective representative analysis frames. The rectangular approximation using the DP technique is performed to minimize a spectral distance between the representative analysis frame and the spectral envelope parameter of the input speech signal. The section length, the analysis frame length and the number of representative frames can be arbitrarily determined in accordance with the application of the vocoder.

Candidate analysis frames for the five representative analysis frames selected from the 20 analysis frames in one section are given as follows.

In this embodiment, a maximum of 7 analysis frame candidates can be assigned to each of the first to fifth representative analysis frames. However, the number of frames represented by each representative frame can be arbitrarily set according to optimal evaluations for speech synthesis reproducibility and predetermined calculation amounts. One of analysis frames (1) to (7) can be a first representative analysis frame in accordance with a time sequence. If a condition for assigning the analysis frame (1) or (7) as the first representative analysis frame is assumed, analysis frame candidates for the second representative analysis frame are frames (2) to (14). In the same way, third representative frame candidates are analysis frames (3) to (18); for the fourth, (7) to (19); and for the fifth, (14) to (20).

Frame selection using the DP technique is performed as follows. A spectral distortion, i.e., a time distortion, is caused by substituting the analysis frames with the representative analysis frame. Subsequently, a quantization distortion, i.e., a spectral distortion in pattern matching is calculated. The time distortion and the quantization distortion are added, and the sum is used as an evaluation threshold value. In this case, the addition order of these two distortions may be reversed.

The time distortion is assumed by exemplifying a combination of the first and second frame candidates.

The spectral distortion, i.e., the time distortion, caused by analysis frame substitutions, can be expressed by a spectral distance between the representative analysis frame and the analysis frame substituted thereby, as shown in the approximation expression in equation (1). $D_{ij}$ in equation (1) is a spectral distance between the frames. At the same time, $D_{ij}$ can be considered to be the spectral distortion, i.e., the time distortion generated when the analysis frame i is substituted by the analysis frame j, and vice versa. Assume that the analysis frames (1) and (2) serve as the first and second representative frames, respectively. In this case, no time distortion caused by frame substitutions occurs, and only quantization distortions are calculated as a total distortion. Assume that the analysis frame (3) is selected as the second representative frame. In this case, $D_3^{(2)}$ can be defined as a minimum total distortion in equation (22) below:

$$D_3^{(2)} = \min \begin{Bmatrix} D_1^{(1)} + D_{1,3} \\ D_2^{(1)} + D_{2,3} \end{Bmatrix} + D_3^{(q)} \tag{22}$$

In equation (22), $D_3^{(2)}$ represents a total distortion when the analysis frame (3) is selected as the second representative analysis frame, and $D_1^{(1)}$ and $D_2^{(1)}$ represent a total distortion when the analysis frame (1) or (2) is selected as the first representative analysis frame.

The total distortion of the first representative analysis frame candidate is calculated such that time distortions, between the analysis frame (1) (as a preceding analysis frame) and other frames, and quantization distortions are respectively added to the measured values. Total distortions are given in equation (23) when the analysis frames (1) to (7) are respectively selected as the first representative analysis frame:

$$\left.\begin{aligned} D_1^{(1)} &= D_1^{(q)} \\ D_2^{(1)} &= d_{2,1} + D_2^{(q)} \\ D_3^{(1)} &= \sum_{i=1}^{2} d_{3,i} + D_3^{(q)} \\ D_7^{(1)} &= \sum_{i=1}^{6} d_{7,i} + D_7^{(q)} \end{aligned}\right\} \tag{23}$$

where $D_1^{(1)}$ to $D_7^{(1)}$ are total distortions of the analysis frames (1) to (7), $D_1^{(q)}$ to $D_7^{(q)}$ are quantization distortions of the analysis frames (1) to (7), $d_{2,1}$ is the time distortion between the analysis frames (1) and (2), $$\sum_{i=1}^{2} d_{3,i}$$

is the sum of the time distortions between the analysis frames (1) and (3) and between the analysis frames (2) and (3), and $$\sum_{i=1}^{6} d_{7,i}$$

is the sum of time distortions between the analysis frame (1) and the analysis frames (2) to (6).

$D_{1,3}$ in equation (22) represents a smaller one of the frame substitution distortions, i.e., the time distortions when the analysis frames (1) and (3) respectively represent the first and second representative analysis frames and the analysis frame (2) can be represented by the analysis frame (1) or (3). $D_{2,3}$ is the time distortion when the analysis frames (2) and (3) respectively represent the first and second representative analysis frames. In this case, $D_{2,3}=0$ and $D_3^{(q)}$ is the quantization distortion of the analysis frame (3).

$$D_{1,3} = \min \begin{Bmatrix} d_{1,2} \\ d_{3,2} \end{Bmatrix} \tag{24}$$

$d_{1,2}$ in equation (24) is the spectral distance between the analysis frames (1) and (2), obtained with equation (21), and $d_{3,2}$ is the spectral distance between the analysis frames (3) and (2).

Equation (22) indicates that when the analysis frame (3) is selected as the second representative analysis frame, one of the analysis frames (1) and (2) with a smaller total distortion can be selected as the first representative analysis frame.

Assume a minimum distortion $D_4^{(2)}$ upon selection of the analysis frame (4) as the second representative analysis frame. In this case, the analysis frame (1), (2) or (3) can be selected as the first representative analysis frame, and the total distortion $D_4^{(2)}$ is given by equation (25) below:

$$D_4^{(2)} = \min \begin{Bmatrix} D_1^{(1)} & D_{1,4} \\ D_2^{(1)} & D_{2,4} \\ D_3^{(1)} & D_{3,4} \end{Bmatrix} + D_4^{(q)} \tag{25}$$

where $D_{1,4}$, $D_{2,4}$ and $D_{3,4}$ are the time distortions, and $D_4^{(q)}$ is the quantization distortion of the fourth analysis frame (4). In this case, $D_{1,4}$ is defined by equation (26) below:

$$D_{1,4} = \min \begin{Bmatrix} d_{1,2} + d_{1,3} \\ d_{1,2} + d_{4,3} \\ d_{4,2} + d_{4,3} \end{Bmatrix} \tag{26}$$

where $d_{1,2}$ and $d_{1,3}$ are the time distortions between the analysis frames (1) and (4) when the analysis frames (2) and (3) are represented by the analysis frame (1), $d_{4,2}$ and $d_{4,3}$ are the time distortions when the analysis frames (2) and (3) are represented by the analysis frame (4), $d_{1,2}$ is the time distortion when the analysis frame (2) is represented by the analysis frame (1), and $d_{4,3}$ is the time distortion when the analysis frame (3) is represented by the frame (4). $D_{2,4}$ and $D_{3,4}$ can be defined in the same manner as in equation (26). Therefore, equation (25) indicates that when the analysis frame (4) is selected as the second representative analysis frame, the first representative analysis frame for giving a minimum distortion, and a combination of analysis frames represented by the first and second representative analysis frames are determined. Total distortions of the first to fifth representative analysis frame candidates are calculated up to that of the fourth representative analysis frame in the same manner as in equations (22) and (25). These total distortions serve as measurement standards for setting a rectangular approximation function for minimizing an approximation error (i.e., a residual distortion) between the reference data with the spectral envelope parameter of the input speech signal.

For example, if the analysis frame (5) serves as the second representative frame, a total distortion is calculated upon selection of, as the first representative analysis frame, one of the preceding analysis frames (1) to (4). Similarly, if the analysis frame (6) serves as the second representative analysis frame, a total distortion is calculated upon selection of, as the first representative analysis frame, one of the preceding analysis frames (1) to (5). Subsequently, the following calculations are performed for the fifth representative analysis frame candidates, and the analysis frames (14) to (20) as the fifth representative analysis frame candidates:

$$D_l = \min \begin{cases} D_{14}^{(5)} + \sum_{i=15}^{20} d_{14,i} \\ D_{15}^{(5)} + \sum_{i=16}^{20} d_{15,i} \\ D_{13}^{(5)} + d_{19,20} \\ D_{20}^{(5)} \end{cases} \quad (27)$$

$D_l$ in equation (27) indicates a minimum total distortion of analysis frames represented by, as the fifth representative analysis frame, one of the analysis frames (14) to (20). $D_{14}^{(5)}$ to $D_{20}^{(5)}$ are the total distortions when the analysis frames (14) to (20) are selected as the fifth representative analysis frame.

$$\sum_{i=15}^{20} d_{14,i}$$

is the sum of time distortions between the analysis frame (14) and the analysis frames (15) to (20), $$\sum_{i=16}^{20} d_{15,i}$$

is the sum of time distortions between the analysis frame (15) and the analysis frames (16) to (20), and $d_{19,20}$ is the time distortion between the analysis frames (19) and (20).

When $D_l$ is determined by equation (27) in units of sections, five representative analysis frames for determining a DP path with a minimum distortion, among combinations of the first to fifth representative analysis frames and the analysis frames represented thereby, are determined, thus easily obtaining variable length framing by optimal sectional rectangular approximation. The scalar value of the quantization distortion in pattern matching is added to the scalar value of the time distortion caused by frame selection with a DP scheme to obtain a total distortion serving as an evaluation value. Subsequently, the evaluation value is used to determine five representative analysis frames and the number (i.e., the repeat bit) of analysis frames represented by the five representative analysis frames. The representative analysis frames are then substituted with label data for designating the spectral envelope reference pattern corresponding thereto. The label data and the repeat bit data are supplied to the multiplexer 216 through a line L22 and a line L23, respectively.

The quantization distortion is considerably larger than the frame substitution distortion by the frame selection with a normal DP path. Therefore, frames with large pattern matching distortions are sequentially eliminated, and the pattern matching data can be output in a variable length frame format.

The exciting source analyzer 212 and the multiplexer 216 have the same functions as those of the previous embodiments.

In the synthesizer unit 2', a multiplexed signal from the analyzer unit 1' is demultiplexed by the demultiplexer 221. The label data and the repeat bit data are supplied to the decoder 222 through respective lines L24 and L25. The exciting source data is supplied to the exciting source generator 223 through a line L26. The pattern decoder 222 reads out the spectral envelope reference pattern corresponding to the reference pattern file 224 and supplies the readout data to the speech synthesis filter 255 for the number of times designated by the repeat bit.

The reference pattern file 224 has the same contents as those of the pattern matching processor 213. The spectral envelope parameters of each analysis frame are supplied to the speech synthesis filter 225.

The exciting source generator 223 receives the exciting source data and generates a pulse train corresponding to a pitch period for a voiced/unvoiced sound, and a white noise exciting source for silence. The pulse train or white noise is amplified in proportion to the magnitude of the source, and the amplified pulse train or white noise is then supplied to the speech synthesis filter 225.

The speech synthesis filter 225, constituting an all-pole digital filter, converts the spectral envelope parameters from the pattern decoder 222 to filter coefficients and synthesizes digital speech, driven by the exciting source from the exciting source generator 223. The digital speech signal is then converted by a D/A converter to an analog signal. An unnecessary high-frequency component of the analog signal is eliminated by an LPF, and the resultant signal appears as an output speech signal on an output line L27.

In the variable frame length type pattern matching vocoder according to this embodiment described above, vector distortions in frame selection and pattern matching are processed in association therewith. Therefore, frames with large pattern matching distortions can be basically eliminated.

In the above embodiments, the analysis parameter need not be limited to the LSP coefficient. Other LPC coefficients may be used. Also in the above embodiments, waveform data, such as a multiple pulse, may be used. Furthermore, the frame length need not be limited to the variable length frame.

What is claimed is:

1. A pattern matching vocoder comprising:

pattern analyzing means for receiving a speech signal and extracting spectral envelope vector patterns thereof;

a first reference pattern memory for storing first reference vector patterns obtained in advance by clustering the spectral envelope vector patterns of a speech sample at a spectral equidistance by using said pattern matching vocoder;

a second reference pattern memory for storing second reference vector patterns obtained in advance by clustering the spectral vector patterns of the same speech sample as that used for said first reference memory according to frequencies of occurrence of the spectral envelope vector patterns of the speech sample; and pattern matching means for matching an output from said pattern analyzing means with a content of said first reference pattern memory to preliminarily select a reference vector pattern, and then for matching the output from said pattern analyzing means with a content of said second reference pattern memory to finally select an optimal reference vector pattern.

2. A vocoder according to claim 1, wherein said pattern analyzing means includes means for calculating a pole frequency of the input speech signal and a pole bandwidth thereof, and bandsplitting means for receiving pole frequency data and pole bandwidth data, dividing the pole frequency and bandwidth data into groups in accordance with the bandwidth, and rearranging and outputting the groups in an order of frequency, the reference vector patterns stored in said second reference pattern memory is obtained by clustering the spectral envelope vector patterns of the speech by the pole frequency, the pole bandwidth and the bandwidth, and said pattern matching means performs pattern matching between an output from said bandsplitting means and a content of said second reference pattern memory in units of bandwidths.

3. A vocoder according to claim 1 or 2, wherein said pattern analyzing means includes LPC means for dividing a speech band of the input speech signal into a plurality of frequency regions and performing linear prediction for each frequency region to calculate LPCs, and means for calculating power ratios between the frequency regions, and said pattern matching means for performing pattern matching using as spectral envelope vector elements an LPC output from said LPC means and an output of the power ratio.

4. A vocoder according to claim 1 or 2, wherein said vocoder comprises frame selecting means for receiving outputs from said pattern analyzing means and said pattern matching means, and for performing frame selection using, as an evaluation element, a total spectral distortion including a spectral distortion caused in association with selection of the reference pattern and a spectral distortion caused by frame selection with dynamic programming.

5. A vocoder according to claim 1 or 2, wherein said pattern analyzing means includes LPC means for dividing a speech band of the input speed signal into a plurality of frequency regions and performing linear prediction for each frequency region to calculate LPC, and means for calculating power ratios between the frequency regions, and said pattern matching means for performing pattern matching using as spectral envelope vector elements an LPC output from said LPC means and an output of the power ratio, and wherein said vocoder comprises frame selecting means for receiving outputs from said pattern analyzing means and said pattern matching means, and for performing frame selection using, as an evaluation element, a total spectral distortion including a spectral distortion caused in association with selection of the reference pattern and a spectral distortion caused by frame selection with dynamic programming.

6. A pattern matching vocoder comprising:

an analyzer unit including an autocorrelation coefficient calculator for calculating autocorrelation coefficients of nth order of input speech, n/2 LPC analyzers for extracting LPCs of second order, (n/2−1) transversal autocorrelation region inverse filters for inverse filtering the autocorrelation coefficients calculated by said autocorrelation coefficient calculator by using the LPCs of second order extracted by said n/2 LPC analyzers, said (n/2−1) transversal autocorrelation region inverse filters being adapted to perform inverse filtering in accordance with input speech spectral envelope inverse frequency characteristics in an autocorrelation coefficient region of the input speech, n/2 pole calculators for calculating n/2 pairs of pole frequencies and pole bandwidths on the basis of the n/2 LPCs respectively extracted by said n/2 LPC analyzers, a bandsplitter for dividing the n/2 pairs of pole frequencies and pole bandwidths into a narrow bandwidth group not exceeding a predetermined bandwidth and a broad bandwidth group exceeding the predetermined bandwidth, and for reordering and outputting the n/2 pairs of the narrow and broad bandwidth groups in an order of frequency, a reference pattern memory for storing a plurality of reference pattern vectors by clustering speech information prepared in advance, clustering being performed using the pole frequencies by said vocoder, the pole bandwidths, the narrow bandwidth group, and the broad bandwidth group, and pattern matching means for receiving output data from said bandsplitter and selecting a label of a reference pattern for minimizing a sum of the weighted squares of differences between vector elements of the output data and the plurality of reference pattern vectors; and a synthesizer unit including a reference pattern memory for storing reference patterns of LPCs associated with spectral envelope vectors corresponding to the reference pattern vectors in said analyzer unit.

7. A vocoder according to claim 6, further comprising:

LPC analyzing means for dividing a speech band of the input speech signal into a plurality of frequency regions, and for performing LPC analysis in units of frequency regions, and means for calculating power ratios between the frequency regions, said pattern matching means being adapted to perform pattern matching using, as the spectral envelope vector elements, the power ratios and outputs from said LPC analyzing means.

8. A vocoder according to claim 6 or 7, further comprising frame selecting means for performing frame selection using, as an evaluation element, a total spectral distortion consisting of a spectral distortion caused by reference pattern selection, and a spectral distortion caused by frame selection with dynamic programming.

* * * * *

UNITED STATES PATENT AND TRADEMARK OFFICE

CERTIFICATE OF CORRECTION

PATENT NO. : 5,027,404

DATED : 6/25/91

INVENTOR(S) : Taguchi

It is certified that error appears in the above-identified patent and that said Letters Patent is hereby corrected as shown below:

Column 1, line 37, after "$1/\pi$", insert --$\int$--;

Column 10, line 8, delete "$\rho_{j+l+1}^{(0)}\ \rho_{j+l+2}^{(0)}$", insert --$\rho_{j+k+1}^{(0)}\ \rho_{j+k+2}^{(0)}$--.

line 19, before "[", insert --•--;

Column 12, line 15, delete "paris", insert --pairs--;

Column 13, line 9, delete "belong", insert --belonging--.

Signed and Sealed this

Seventeenth Day of November, 1992

*Attest:*

DOUGLAS B. COMER

*Attesting Officer*

*Acting Commissioner of Patents and Trademarks*